US005957619A

United States Patent [19]

Kinoshita et al.

[11] Patent Number: 5,957,619

[45] Date of Patent: Sep. 28, 1999

[54] METHOD OF CONSTRUCTING BLOCK PAVEMENT

[75] Inventors: Shoji Kinoshita; Norio Nishizawa, both of Tokyo; Katsutoshi Satou, Tochigi; Takurou Kurokawa, Shiga, all of Japan

[73] Assignees: Taisei Rotec Corporation; Nichireki Co., Ltd., both of Tokyo, Japan

[21] Appl. No.: 08/849,398

[22] PCT Filed: Oct. 14, 1996

[86] PCT No.: PCT/JP96/02968

§ 371 Date: Jun. 6, 1997

§ 102(e) Date: Jun. 6, 1997

[87] PCT Pub. No.: WO97/13923

PCT Pub. Date: Apr. 17, 1997

[30] Foreign Application Priority Data

Oct. 12, 1995 [JP] Japan ..... 7-289197

[51] Int. Cl.[6] ..... E01C 3/00

[52] U.S. Cl. ..... 404/31; 404/82

[58] Field of Search ..... 404/17, 27, 28, 404/29, 30, 31, 71, 82, 34, 37, 40, 43; 264/DIG. 31

[56] References Cited

U.S. PATENT DOCUMENTS

| | | | |
|---|---|---|---|
| 378,825 | 2/1888 | Brannigan | 404/34 |
| 496,099 | 4/1893 | Robinson | 404/29 |
| 710,062 | 9/1902 | Leary | 404/34 |
| 847,471 | 3/1907 | Gross | 404/34 X |
| 1,348,959 | 8/1920 | Rhodes | 404/34 |
| 1,541,830 | 6/1925 | Larranaga | 404/29 |
| 1,548,627 | 8/1925 | Peters | 404/29 |
| 2,718,829 | 9/1955 | Seymour et al. | 404/31 |
| 3,969,851 | 7/1976 | Whitacre | 404/17 X |

FOREIGN PATENT DOCUMENTS

| | | | |
|---|---|---|---|
| 259735 | 3/1988 | European Pat. Off. | 404/37 |
| 4004644 | 8/1991 | Germany | 404/37 |
| 7113204 | 5/1995 | Japan . | |
| 5612402 | 3/1997 | Japan . | |

OTHER PUBLICATIONS

"Second International Conference on Road & Airfield Pavement Technology", Proceedings vol. 2, pp. 541–549, Shangri–La Hotel, Singapore, Sep. 27–29, 1995.

Manual For Asphalt Pavement, pp. 176–179, 1993.

*Primary Examiner*—James A. Lisehora

*Attorney, Agent, or Firm*—Browdy and Neimark

[57] ABSTRACT

The present method of constructing block pavement, which solves conventional problems, is applicable not only to landscape pavement of a sidewalk or an open space, but also to an ordinary roadway having heavy traffic of large vehicles, and makes available block pavement provided with a beautiful appearance and an excellent durability. This method involves the steps of providing a tack coat layer by spraying an asphalt emulsion on a base of a road or the like; then placing an aggregate on the upper surface thereof to form an aggregate layer; arranging a plurality of paving blocks on the upper surface thereof while keeping the upper surfaces of the blocks in flush; then pouring uniformly a cement asphalt mortar from joint spaces formed between the paving blocks to fill the void of the aggregate layer to form a buffer support layer; and filling also the joint spaces uniformly with the cement asphalt mortar or a pouring joint filler material other than the cement asphalt mortar, thereby securing the paving blocks integrally on the base.

21 Claims, 5 Drawing Sheets

METHOD OF CONSTRUCTING BLOCK PAVEMENT

BACKGROUND OF THE INVENTION

1. Field of the Invention

The present invention relates to a method of constructing block pavement. More particularly, the present invention relates to a method of constructing block pavement which is applicable to a sidewalk, a community road, a shopping mall, a cycling road, a park, an open space, a parking space and an ordinary roadway, and is excellent in appearance and durability.

2. Description of the Related Art

While block pavement has long been applied, it has been applied in a full scale to ordinary roadways only recently.

A conventional method of constructing a block pavement as a general practice comprises the steps of laying and leveling cushion sand on a subbase course or a base course, or a base of the road so on, arranging paving blocks, roller-compacting the surfaces thereof with a roller compactor, and filling up the joint spaces between the thus arranged paving blocks with joint filler sand for finishing. Application of this conventional method for constructing block pavement on a roadway poses however the following problems. More specifically, in block pavement constructed by this method using non-adhesive sand, joint filler sand flows out or splashes under the effect of rain water or wind. As a result, traffic of vehicles accelerates generation of shock and vibration, which cause displacement of cushion sand, thus resulting in early occurrence of destruction of the block pavement.

With a view to coping with these problems, therefore, there has been proposed and applied a method using a dry-mixed cement mortar formed by mixing cement and sand in place of conventional cushion sand and joint filler sand. This method comprises the steps of placing and leveling dry-mixed cement mortar, arranging and roller-compacting paving blocks thereon, filling up the joint spaces with the dry-mixed cement mortar, then sprinkling water thereonto, and causing rain water to generate a hydration reaction of cement contained in the dry-mixed cement mortar to fix cushion sand and joint filler sand into mortar state with the dry-mixed cement mortar, thereby securing the paving blocks onto the base course to construct block pavement.

In this method, however, although giving an effect to some extent for light traffic, the solidified dry-mixed cement mortar is brittle, so that joints suffer from early occurrence of cracks under heavy traffic of large vehicles on an ordinary road. Joints are broken into pieces, and the result is almost the same as in a case using cushion sand, leading to breakage of the block pavement.

Other methods proposed for fixing cushion sand and joint filler sand upon constructing block pavement include one comprising spraying a water-soluble prepolymer to fix cushion sand and joint filler sand, and one using a mixture of a hydraulic slag and a water-soluble macromolecular substance in place of cushion sand and joint filler sand. These methods are defective in that the pavement suffers from cracks under heavy traffic and rain water causes joint filler sand to flow out, and the problem of block pavement broken under heavy traffic involving large vehicles on an ordinary road.

The present invention has an object to provide a method of constructing block pavement, which solves these conventional problems, is applicable not only to landscape pavement of a sidewalk or an open space, but also to an ordinary roadway having heavy traffic of large vehicles, and makes available block pavement provided with a beautiful appearance and an excellent durability.

SUMMARY OF THE INVENTION

The present invention proposes a method of, upon constructing block pavement, using a cement asphalt mortar (hereinafter simply referred to as "CA mortar") as means to fix paving blocks.

More specifically, the present invention provides a method of constructing block pavement provided with a beautiful appearance and an excellent durability, which comprises the steps of providing a tack coat layer by spraying an asphalt emulsion on a road base, then, forming an aggregate layer by placing and leveling aggregates on the upper surface thereof, arranging a plurality of blocks on the upper surface thereof with upper surfaces of the blocks in flush, pouring CA mortar into joint spaces formed between the blocks by means of a pouring pot, a pouring funnel or a tremie pipe, forming a buffer support layer by filling up void of the foregoing aggregate layers by pouring uniformly, filling the foregoing joint spaces with CA mortar or a pouring joint filler material other than CA mortar to integrally secure the blocks onto the base.

CA mortar used in the method of constructing block pavement in the present invention is to give the viscoelasticity in addition to being adhesive unlike ordinary cement mortar. The buffer support layer formed by filling up void of the aggregate layers which are supporting layers of the blocks with CA mortar has an excellent function as an adhering layer as well, firmly bonding the base and the blocks through the tack coat layer, and at the same time, block are effectively secured to each other by joints comprising CA mortar or a pouring joint filler material other than CA mortar filling the joint spaces. It is thus possible to provide block pavement capable of sufficiently withstanding even when applied to an ordinary roadway.

Since the CA mortar used in the method of constructing block pavement is to give the viscoelasticity unlike ordinary cement mortar, the buffer support layer as an adhering layer has an excellent function also as a cushion layer which absorbs and alleviates shock and vibration caused by traffic of vehicles, and at the same time, the joints comprising CA mortar or a pouring joint filler material other than CA mortar filling the joint spaces can well cope with behavior of the individual blocks caused by vehicle traffic, and can provide block pavement excellent in durability even under heavy traffic.

BRIEF DESCRIPTION OF THE DRAWINGS

FIG. 1 is longitudinal sectional side view illustrating a state in which paving blocks are temporarily placed on an aggregate layer formed by laying aggregates;

FIG. 2 is a longitudinal sectional side view illustrating pouring of CA mortar to the void of aggregate layer and joint spaces; and FIG. 3 is a longitudinal sectional side view illustrating completed block pavement.

DESCRIPTION OF THE PREFERRED EMBODIMENTS

Figure 1:
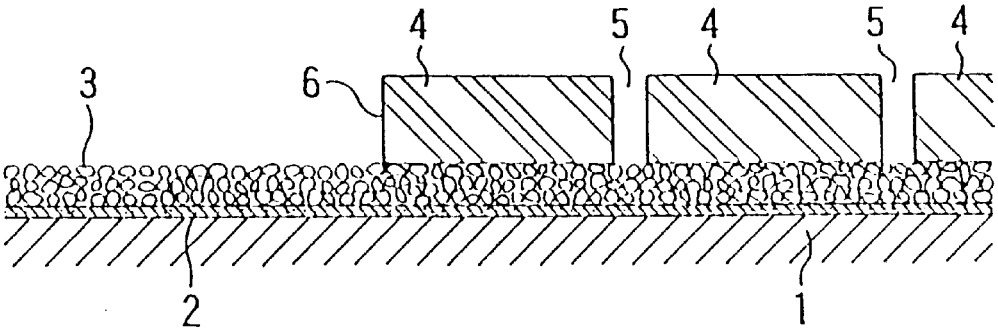
FIGS. 1, 2 and 3 are longitudinal sectional side views illustrating an outline of application of the method of constructing block pavement in the present invention.

Now, the method of constructing block pavement of the present invention will be described below in detail.

The term "base" as used in the present invention means, for example, existing asphalt pavement, concrete pavement or a base course, and further include soil-based pavement in a sidewalk, a park or an open space, bridge surface pavement, a concrete slab or a steel floor slab.

The term "asphalt emulsion" as used in the present invention means an asphalt emulsion or a modified asphalt emulsion.

An asphalt emulsion is formed by emulsifying and dispersing asphalt in water with the use of an emulsifier, a dispersant or a stabilizer. Asphalt emulsions are classified, in terms of the emulsifier used for emulsification, into cationic asphalt emulsion, anionic asphalt emulsion, nonionic asphalt emulsion and clay-type emulsion. In the present invention, a cationic asphalt emulsion is used as the tack coat layer on the base. Applicable cationic asphalt emulsion include, for example. PK1 to 4 specified in JIS K2208 Standard for Emulsified Asphalt. A nonionic asphalt emulsion is mainly used as the asphalt emulsion for CA mortar. Values of standard for nonionic asphalt emulsions are set forth in JIS K2208 Standard for Emulsified Asphalt, MN-1.

A modified asphalt emulsion is prepared by mixing asphalt with natural rubber, a macromolecular polymer or the like, and emulsifying and dispersing the thus modified asphalt in water by the use of an emulsifier, a dispersant and a stabilizer, or adding and mixing natural rubber, a macromolecular polymer latex or an emulsion to the above asphalt emulsion. Representative modified asphalt emulsions include PKR-T and PKR-S specified in the standard for rubber-modified asphalt emulsions published by the Japan Emulsified Asphalt Association.

Aggregates applicable in the present invention include those specified in the "MANUAL FOR ASPHALT PAVEMENT" published by the Japan Road Association: crushed stone, cobble stone, gravel, and blast furnace slag. An asphalt-coated aggregate made by coating any of these aggregates with asphalt or a recycled aggregate is also applicable. Granular materials similar to those mentioned above such as an artificial burnt aggregate, a burnt foamed aggregate, an artificial lightweight aggregate, a ceramic grains and emery are applicable as well. Furthermore, aggregates may be single-sized or have a continuous grading. The grade 6. crushed stone or cobble stone having a particle size within a range of from 5 to 13 mm is generally adopted.

The paving block used in the present invention is a natural stone, a paving concrete plate, a brick, an interlocking block, an elastic block or a tile. Fine grooves should preferably be provided on the bottom surface of the paving block.

Stones such as marble, granite, andesite and Mikage-granite may be used as a natural stone. Applicable stone shapes include a cube rubble, a formed stone slab and a non-formed stone slab.

Applicable paving concrete plates include ones specified in JIS A5304: an ordinary block, a colored block, a mortar washed out surface block, and an imitation stone block, and in addition, a porous block, a tile worn block and a pictured surface block are also applicable.

As bricks, an ordinary brick, and an interlocking brick can be used and ordinary bricks complying with JIS R1250 are applicable.

The interlocking block should be in conformity to the quality requirements for interlocking block as set forth in the "Interlocking Block Pavement" edition 1994 published by the Japan Interlocking Block Association.

An elastic block is prepared by adding a liquid urethane resin as a binder to granular rubber obtained mainly by milling waste tires and forming the mixture through heating and compression.

Applicable tiles include porcelain, stoneware and ceramic ware type ones as specified in JIS A5209. An elastic tile prepared by imparting viscoelasticity to a tile is also applicable.

The CA mortar as used in the present invention comprises, relation to 100 weight parts cement, from 50 to 230 weight parts asphalt emulsion, from 0 to 100 weight parts rapid-hardening admixture, from 60 to 330 weight parts fine aggregate, from 0 to 5 weight parts setting adjusting agent, from 0 to 0.05 weight parts aluminum powder, from 0 to 40 weight parts expansive admixture, from 1 to 5 weight parts additive, and added water in a required amount.

Cement used in the CA mortar should be any of, for example, normal Portland cement, high-early-strength Portland cement, extra-high-early-strength Portland cement, moderate heat Portland cement, Blast-furnace slag cement, silica cement, fly ash cement, sulfate resistant cement and jet cement.

The asphalt emulsion used in the CA mortar may or may not contain a polymer, whereas a polymer-modified asphalt emulsion is preferable.

A polymer-modified asphalt emulsion is a nonionic asphalt emulsion obtained by mixing an asphalt emulsion and a synthetic latex at a weight ratio of 99 to 75:1 to 25, or more preferably, 95 to 75:5 to 25. The asphalt emulsion used in the polymer-modified asphalt emulsion should be a nonionic asphalt emulsion prepared by emulsifying and dispersing asphalt in water by the use of a nonionic emulsifier, a dispersant and a stabilizer. The solid content in a nonionic asphalt emulsion must usually be within a range of from 40 to 70 wt. %. With a solid content of under 40 wt. %, it is impossible to impart a satisfactory viscoelasticity to the CA mortar. With a solid content of over 70 wt. %, on the other hand, an increased value of viscosity impairs availability of a satisfactory CA mortar. Asphalt in the nonionic asphalt emulsion should preferably have a penetration (at 25° C.) within a range of from about 40 to 300, after due consideration of the physical properties after the CA mortar hardened.

The synthetic latex used in the polymer-modified asphalt emulsion should be any of an SBR latex, an acrylic latex and an EVA latex. In the present invention, an SBR latex is mainly used. The SBR latex is weak-alkaline and has a satisfactory mixing ability with cement and a nonionic asphalt emulsion. The SBR latex has usually a solid content of 50 wt. %.

Usually a polymer-modified asphalt emulsion is obtained by high speed mixing of synthetic latex with nonionic asphalt emulsion to disperse synthetic latex into nonionic asphalt emulsion uniformly.

Generally, the weight ratio of nonionic asphalt emulsion and synthetic latex in a polymer-modified asphalt emulsion should be within the range of 99 to 75:1 to 25, or more preferably, 95 to 75:5 to 25. With a consumption of the synthetic latex of under 1 weight part, it is impossible to impart a satisfactory viscoelasticity to the CA mortar. A consumption of the synthetic latex of over 5 weight parts is preferable, because it makes possible to impart a satisfactory viscoelasticity. On the other hand, with a consumption of the synthetic latex of over 25 weight parts, the viscoelasticity of a polymer-modified asphalt emulsion becomes too high to obtain satisfying CA mortar. In addition, it becomes difficult to transfer CA mortar with the pressure generated by pump operation.

The consumption of the polymer-modified asphalt emulsion should usually be within a range of from 50 to 230 weight parts relative to 100 weight parts cement. With a consumption of the polymer-modified asphalt emulsion of under 50 weight parts, it is impossible to impart a satisfactory viscoelasticity. With a consumption of the polymer-modified asphalt emulsion of over 230 weight parts, on the other hand, a reduced strength of CA mortar causes a decrease in the supporting force of the CA mortar filled up layer.

The rapid-hardening admixture used for CA mortar is a mixture obtained by mixing calcium aluminate and gypsum anhydride at a weight ratio of 1:1.4 to 2.9. This mixture imparts rapid-hardenability to cement and permits rapid expression ability of strength of CA mortar. With a blending ratio of gypsum anhydride of under 1.4, rapid-hardenability is low. With a blending ratio of gypsum anhydride of over 2.9, on the other hand, rapid-hardenability becomes excessively high, making it difficult to control the available time.

The consumption of the rapid-hardening admixture should be within a range of from 0 to 100 weight parts relative to 100 weight parts cement, or more preferably, from 0 or 40 to 70 weight parts. With a consumption of the rapid-hardening admixture of over 100 weight parts, rapid-hardenability becomes excessively high, making it difficult to carry on operations.

The fine aggregate used in CA mortar is any of river sand, land sand, pit sand, screenings and silica sand. The particle size thereof should usually be such that the FM-value (fineness module) is preferably within a range of from 1.0 to 1.6. An FM-value of under 1.0 leads to a higher viscosity and hence to a lower filling up property of CA mortar. An FM-value of over 1.6 leads to easy occurrence of material separation.

In place of the fine aggregate, a mineral powder material such as fly ash or silica powder may be used.

The consumption of the fine aggregate should usually be within a range of from 60 to 330 weight parts relative to 100 weight parts cement. With a consumption of the fine aggregate of under 60 weight parts, CA mortar after hardening tends to suffer from easy occurrence of volume shrinkage. A consumption of the fine aggregate of over 330 weight parts causes material separation, making it difficult to continue operations.

The setting adjusting agent used in CA mortar is polycarboxylic acid or the like including, for example, a jet setter, useful for adjusting the available time of CA mortar. The consumption of the setting adjusting agent should usually be within a range of from 0 to 5 weight parts relative to 100 weight parts cement. With a consumption of the setting adjusting agent of over 5 weight parts, early expression of strength cannot be expected, although the available time is sufficient.

Aluminum powder used in CA mortar is used for adjusting the expansion coefficient in an amount within a range of from 0 to 0.05 weight parts. A consumption of over 0.05 weight parts should be avoided because it may lead to expansion cracks of CA mortar.

Expansive admixture used for CA mortar include lime-based and CSA-based ones. The expansion admixture is effective not only for preventing cracks caused by volume shrinkage of CA mortar poured and filled up the void of aggregate layer and joint spaces, but also for preventing material separation of CA mortar to bring about dispersibility and watertightness. The consumption of the expansive admixture should usually be within a range of from 0 to 40 weight parts, or more preferably, from 0 or 10 to 15 weight parts relative to 100 weight parts cement. A consumption of the expansive admixture of over 40 weight parts should be avoided since it may cause expansion cracks of CA mortar.

Additives used for CA mortar include a fluidizing agent and an air entraining agent. The fluidizing agent is for improving operability of CA mortar, and the air entraining agent is effective for improving freezing resistance of CA mortar. The consumption of each of these additives is usually within a range of from 1 to 5 weight parts relative to 100 weight parts cement. A consumption of the fluidizing agent of under 1 weight part can give no effect, whereas a consumption of over 5 weight parts should be avoided because it causes material separation or defective hardening of CA mortar. A consumption of the air entraining agent of under 1 weight part gives no effect, whereas a consumption of over 5 weight parts seriously hinders hardening of CA mortar. The fluidizing agent and the air entraining agent may be used singly or in combination.

As additive water used for CA mortar, fresh water is usually used, such as, for example, supply water, industrial water, ground water or river water.

CA mortar used in the present invention can be prepared by the following method. The first charging the asphalt emulsion in a required amount into a prescribed container, adding additive water, the setting adjusting agent and the additives in required amounts to prepare a mixed liquid, by the use of a hand-type portable mixer, then adding cement, the rapid-hardening admixture, the fine aggregate and aluminum powder in respective required amounts to this mixed liquid, and kneading the resultant solution through high-speed stirring, by the use of a hand-type portable mixer, thereby preparing CA mortar of the present invention. For the purpose of improving the operational efficiency, a mixture prepared by blending the rapid-hardening admixture, the fine aggregate and aluminum powder in respective required amounts may be added to cement, or an asphalt emulsion prepared by previously mixing additives in required amounts into the asphalt emulsion may be used. The thus prepared CA mortar should immediately be subjected to pouring operation in practice.

The above fine aggregate used for CA mortar is used as the joint filler sand in the present invention.

As the joint filler material other than CA mortar used for filling the joint spaces, a heating-type joint sealer or a cold joint sealer is used. A heating-type joint filler is selected from among elastomer asphalt and elastomer resin fillers. A cold joint sealer is selected from polysulfide, urethane resin, epoxy resin, acryl resin and silicon resin filler products for the road joint.

Now, application of the method of constructing block pavement of the present invention will be described below with reference to the drawings.

In FIG. 1, 1 is a base comprising, for example, existing asphalt pavement, and 2 is a tack coat layer formed by spraying an asphalt emulsion on the base 1. Under a certain condition of the site, a tack coat layer is not provided. In order to ensure a firm adherence of the base layer and the aggregate layer, however, it is preferable to provide a tack coat layer. In FIG. 1, 3 is an aggregate layer formed by placing aggregates on the base; and 4 is a paving block in a temporary placing state as arranged on the aggregate layer 3. Joint spaces 5 are formed between adjacent paving blocks 4, 4 . . . thus arranged; 6 are side portion of the paving blocks 4, 4 . . . opposite to each other at the joint space 5. Previously coating the surfaces of the side portions 6, 6 . . . and the bottom surfaces of the paving blocks 4, 4 . . . with an asphalt coating of an asphalt emulsion is effective for improving adhesion between the paving blocks 4 and a buffer support layer 9 described later in this specification.

Figure 2:
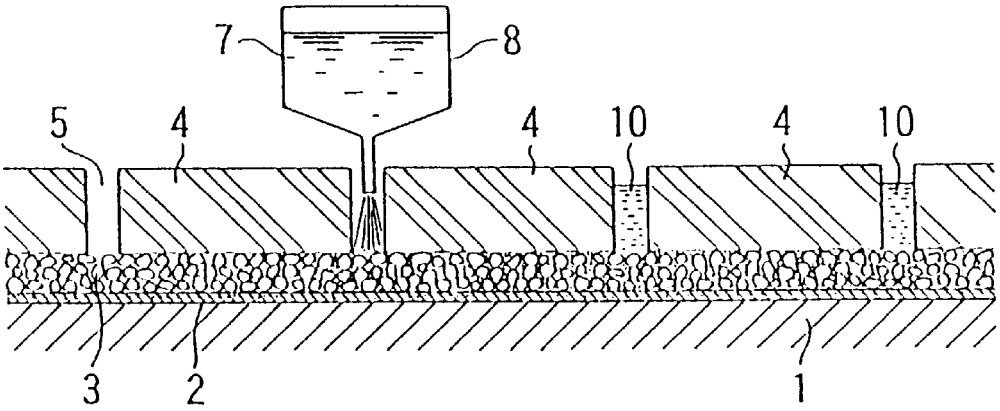
Figure 3:
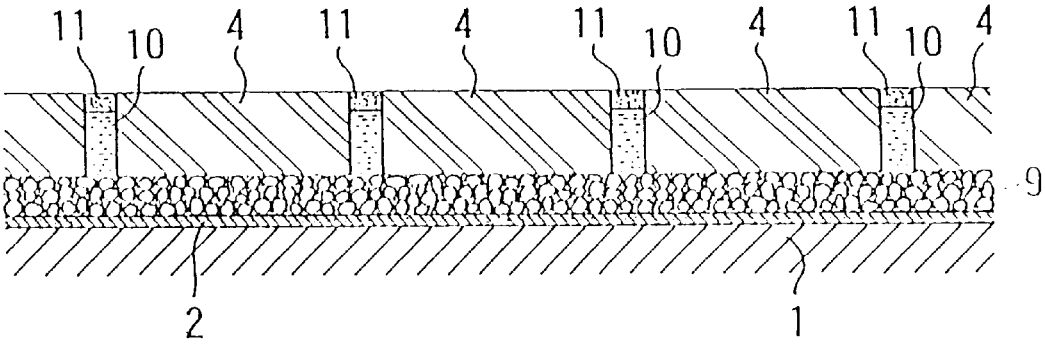

In FIG. 2, 7 is CA mortar which is poured along joint spaces 5 by means of a pouring pot 8. The poured CA mortar 7 fills up the void of the aggregate layer 3, bonds individual pieces of aggregate for solidification, and forms a cement asphalt concrete (hereinafter simply referred to as "CA concrete") in which CA mortar and aggregate are mixed and solidified. The CA concrete layer, formed by adhesive and viscoelastic CA mortar and aggregate, firmly secures the base 1 and the paving blocks 4, elastically supports the paving blocks 4, 4 . . . , and serves as a buffer support layer 9 which effectively absorbs and alleviates shock and vibration caused by traffic of vehicles. CA mortar 7 filled up the joint spaces 5 forms an elastic joint filler 10, and combines the paving blocks 4, 4 . . . . While all the joint spaces 5 may be filled with this elastic filler 10, joint spaces may partially be left at top portions of the joint spaces 5 which may be filled with joint filler sand 11, as shown in FIG. 2 and 3.

After filling the aggregate layer with CA mortar, the joint spaces 5 may be filled with a heating-type joint filler or an ambient-temperature joint filler other than CA mortar. When the joint spaces 5 are filled with a pouring joint filler other than CA mortar, it is possible to further improve imperviousness of joints in service, and follow up property to expansion and shrinkage of the joints.

Figure 4:
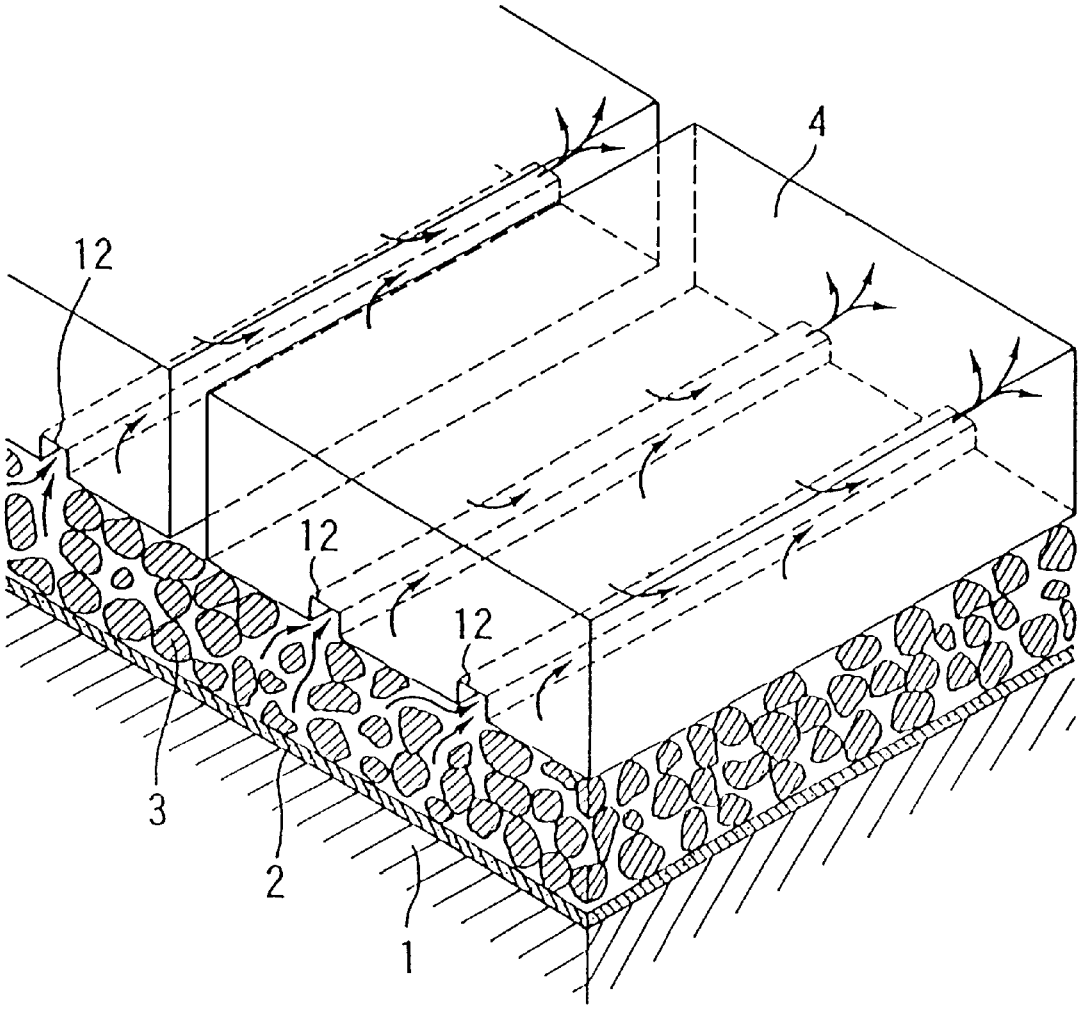
FIG. 4 illustrates provision of fine grooves on the bottom surface of a paving block.

Fine grooves 12 may be provided as shown in FIG. 4 on the bottom surfaces of the paving blocks 4. By providing these fine grooves 12 on the bottom surface of the paving block 4, air in the aggregate layer 3 is promptly discharged outside through these fine grooves 12 upon pouring CA mortar as shown by an arrow in FIG. 4. It is therefore possible to improve the filling up speed of CA mortar. Since CA mortar itself can flow through the fine grooves 12, there is available an effect that CA mortar can be rapidly poured even into a depth of the aggregate layer 3 covered with the paving blocks 4. In addition, CA mortar which has been poured and filling up the fine grooves 12 and has hardened there can serve as a stopper of the paving block 4 relative to the buffer support layer 9, and has a function of preventing the paving blocks 4 from moving forward and backward and to the right and to the left under the effect of vibration and shock of vehicles.

FIG. 4 shows provision of two parallel fine grooves 12 in a direction on one paving block 4. The direction and number of the fine grooves are not however limited to the above, but two additional fine grooves may be provided in a direction at right angles to the two fine grooves 12 shown in FIG. 4, or may be diagonally crossed each other provided. It is needless to mention that three or more fine grooves may be provided per paving block, or on the contrary, a single such fine groove may be provided. When providing a smaller number of grooves, it is favorable to increase the width and the depth of a groove.

Figure 5:
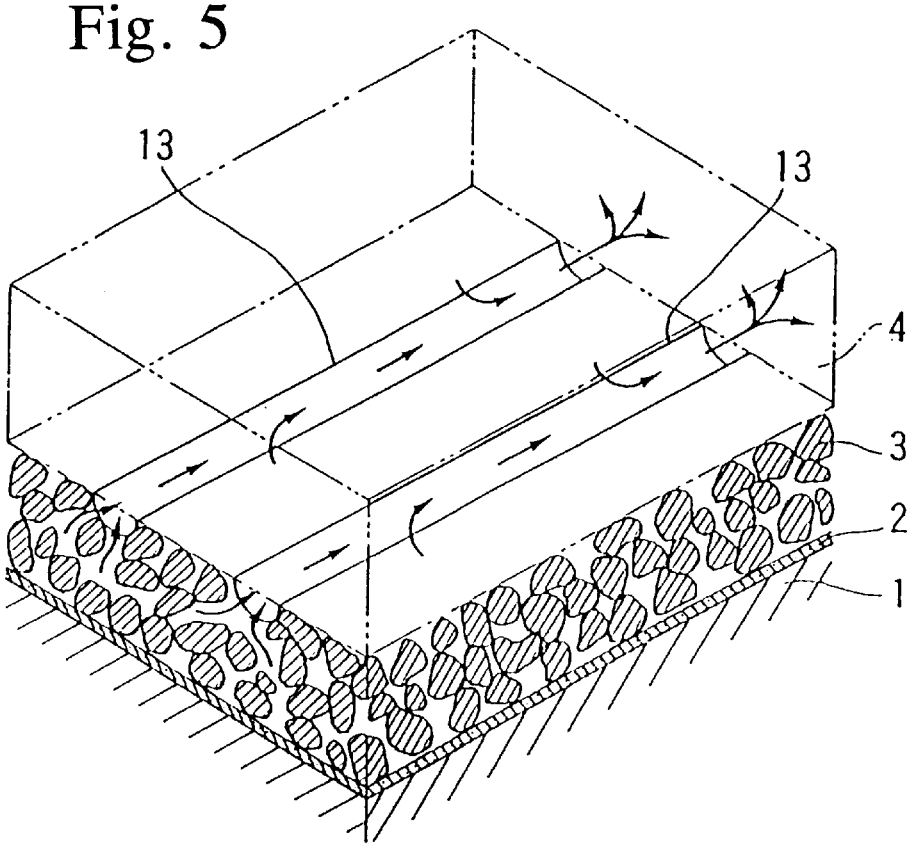
FIG. 5 illustrates provision of fine grooves on the upper portion of the aggregate layer.

In place of providing fine grooves on the bottom surface of the paving block, a fine groove 13, as shown in FIG. 5 for example, may be provided on the upper surface of the aggregate layer 3. This fine groove 13 may be formed by any method, for example, by disentangling pieces of aggregate on the upper surface of the aggregate layer 3 and removing part of aggregates. It may be formed by making a groove-shaped recess on the upper surface of the aggregate layer 3 by pushing a formed plate against the layer 3. Discharge of air in the aggregate layer 3 as a result of filling of CA mortar is promptly accomplished through the fine groove 13 provided on the upper surface of the aggregate layer 3 as shown by an arrow in FIG. 5. Since CA mortar itself can flow through this fine groove, it is possible to rapidly fill up even the void of the aggregate layer covered with the paving block 4 with CA mortar.

While FIG. 5 covers a case with two parallel fine grooves 13 per paving block, the number of grooves and the direction thereof are not limited to the above. The fine grooves 13 may be provided diagonally to the paving block, or may cross each other.

Figure 6:
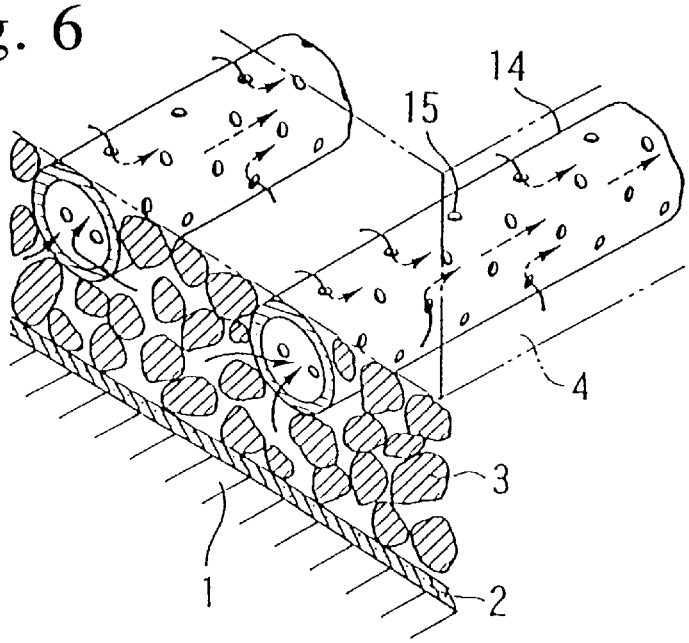
FIG. 6 illustrates a hollow porous pipe buried in a fine groove provided on the upper portion of the aggregate layer.

A hollow porous pipe 14 may be buried in the fine groove 13 provided in the aggregate layer 3 as shown in FIG. 6. The hollow porous pipe 14 may be made of a metal such as steel or plastics such as polyvinyl chloride. The buried pipe is not limited to the one shown in FIG. 6, but may be a pipe formed by winding a metal wire such as a steel one or a plastic wire such as a polyvinyl chloride one into a coil spring shape, or a hollow gridiron pipe made of a metal such as steel or a plastics such as polyvinyl chloride. It is also possible to use these hollow porous, coil-spring-like and hollow gridiron pipes in an appropriate combination.

As shown in FIG. 6, along with filling of CA mortar, air in the aggregate layer 3 flows from a hole 15 of the hollow porous pipe 14 into the interior of the hollow porous pipe 14, and is rapidly discharged outside through the hollow porous pipe 14.

In the above description, the case with fine grooves provided in the paving block, the case with fine grooves provided on the upper portion of the aggregate layer, and the case with a hollow porous pipe provided in a fine groove on the upper portion of the aggregate layer have been presented as separate examples, but these three means may of course be appropriately combined.

Figure 7:
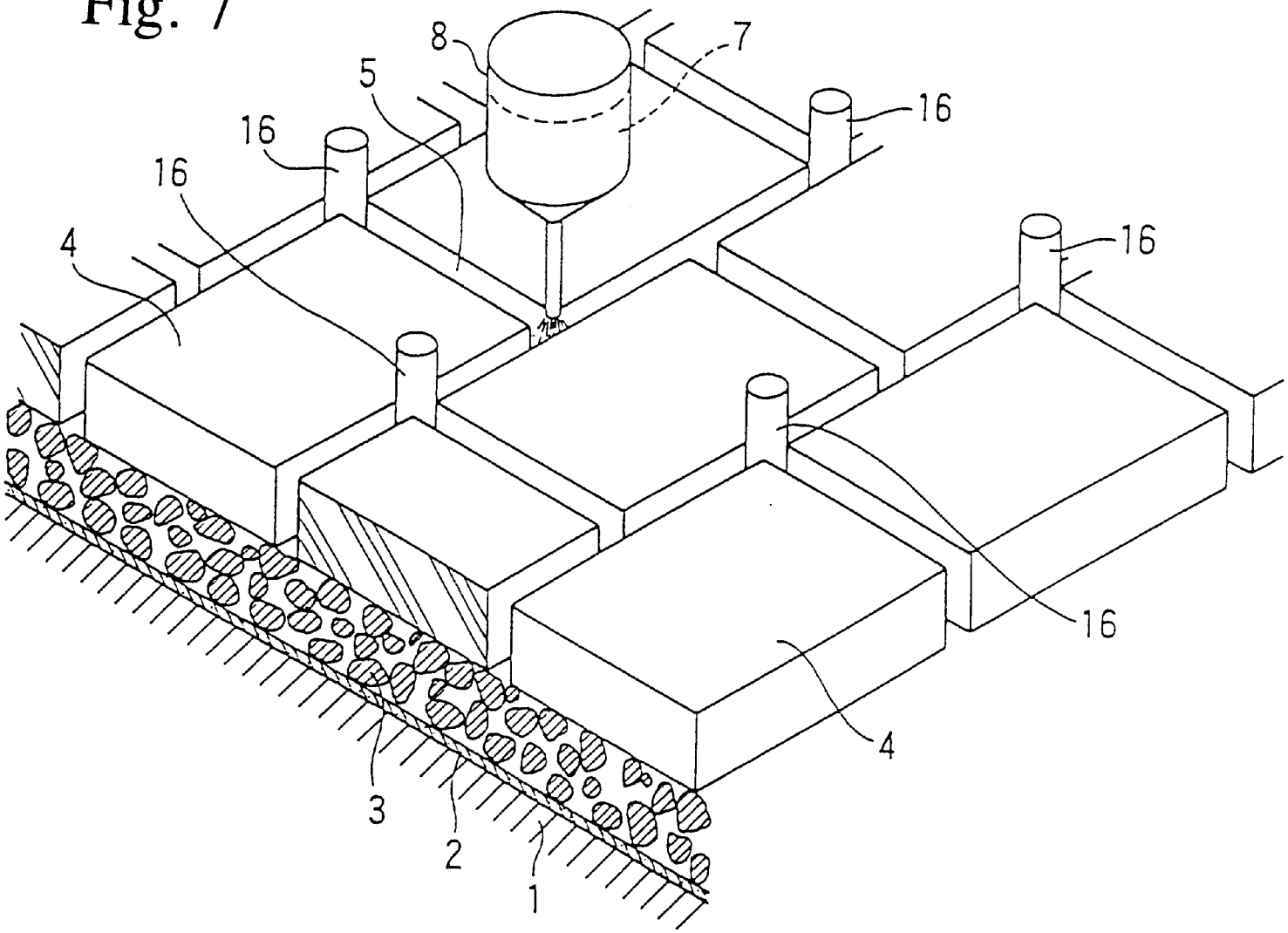
FIG. 7 illustrates temporary provision of a joint space stopper as CA mortar flowing stopper.

Upon pouring CA mortar, joint space stoppers 16, 16 . . . , as CA mortar flowing stopper, should preferably be temporarily provided at appropriate flat positions of the joint spaces 5 formed between the paving blocks 4, 4 . . . as shown in FIG. 7. The joint space stoppers 16, 16 . . . are round-rod-shaped members made of foamed styrol, for example, with the lower end thereof in contact with the upper surface of the aggregate layer 3, installed substantially vertically to fill the joint spaces 5. The joint space 5 is divided into a plurality of flat areas by the plurality of joint space stoppers 16, 16 . . . . While a joint space stopper is temporarily provided at a point of intersection of three paving blocks in FIG. 7, the position of temporary installation is not limited to the above, but installation may be at any arbitrary position of the joint spaces formed by adjacent paving blocks.

Figure 8:
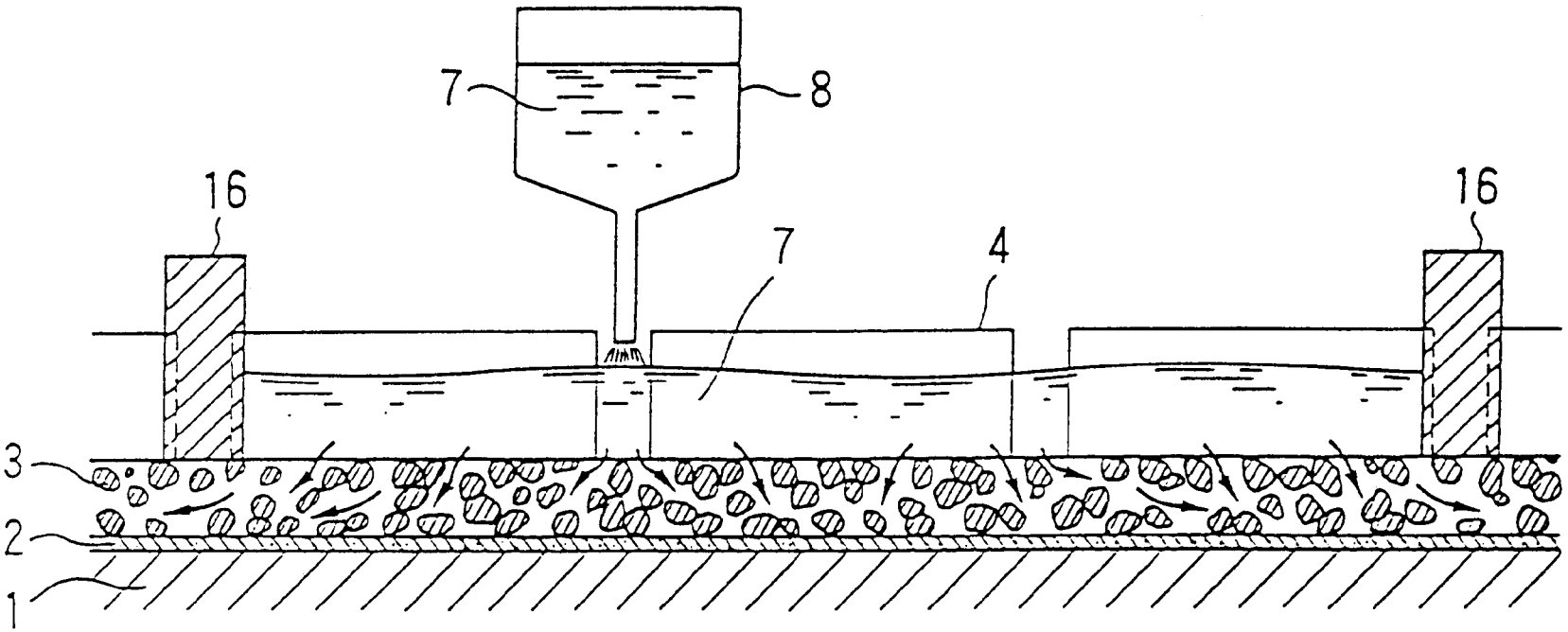
FIG. 8 is a longitudinal sectional side view illustrating pouring of CA mortar into joint spaces partitioned by the joint space stopper.

FIG. 8 illustrates a case where CA mortar is poured into an area of the joint space 5 surrounded by the joint space stoppers 16, 16 . . . . As is clear from FIG. 8, the poured CA mortar is dammed up by the joint space stoppers 16, 16 . . . clogging the joint spaces 5, and never diffuses to the aggregate layer surface in a range wider than the necessary extent. In CA mortar staying within a certain area, an osmotic pressure of CA mortar into the aggregate layer 3 is produced by the gravity, permitting rapid penetration into the aggregate layer 3 as shown by an arrow in FIG. 8, leading to improvement of filling up operation efficiency of CA mortar and filled up ratio.

After sufficient penetration and filling up of CA mortar into the aggregate layer 3, the joint space stoppers 16, 16 . . . are removed, and then, CA mortar or a joint filler material other than CA mortar is poured into the joint spaces 5.

Now, the features of the present invention will be described below in detail by means of examples.

(EXAMPLE 1)

The method of constructing block pavement of the present invention was applied to an existing asphalt pavement road which was estimated the road classification A by traffic volume on the basis of about 80 of one way daily traffic of the line buses as heavy vehicles.

The tack coat layer in this Example is provided for firmly bonding a buffer support layer filled with CA mortar which is an adhering layer of existing asphalt pavement forming a base and paving block to the base. The asphalt emulsion used for this tack coat was rubberized cationic asphalt emulsion, and actually, CATIOZOL GM made by NICHIREKI COMPANY (evaporation residue: 55.0 wt. %, penetration of evaporation residue (at 25° C.): 93) was employed.

The aggregate layer in the Example is first formed by laying the grade 6. crushed stone on a base, having a tack coat layer for installing paving blocks, into a thickness of about 3 cm. After filling up and solidification of CA mortar into the void between pieces of aggregate in the aggregate layer upon the completion of installation of the paving blocks, the aggregate layer serves as a bonding layer between the base and the paving blocks, and in service, functions as a buffer support layer which effectively absorbs and alleviates shock and vibration caused by traffic of vehicles. This buffer support layer also plays the role of an irregularities correcting layer when the base contains surface irregularities of flatness.

For balance in landscape because the site was adjacent to a park, a natural stone was used. The stone block was a formed stone of Mikage-granite produced in China (size=30 cm long, 30 cm wide, 12 cm thick).

The natural stone block had previously been covered with an asphalt coating on the sides and bottom thereof to intensify adherence to the buffer support layer formed with aggregate and CA mortar and the elastic joints formed with CA mortar. The same material as that used in the tack coat was used in the asphalt coating of the natural stone block, as an asphalt emulsion.

CA mortar comprised, relative to 100 weight parts cement, 200 weight parts polymer-modified asphalt emulsion, 56 weight parts rapid-hardening admixture, 166 weight parts fine aggregate, 0.7 weight parts setting adjusting agent, 0.03 weight parts aluminum powder, 1.0 weigh parts air entraining agent as an additive, and 30 weight parts water as additive water.

Cement used was normal Portland cement made by Chichibu-Onoda Cement Corporation. NICHIREKI COMPANY's NICHIREKI PMS Emulsion (nonionic asphalt emulsion: synthetic latex=87.5:12.5, evaporation residue: 60.5 wt. %, penetration (at 25° C.): 87) was used as a polymer-modified emulsion. APS made by ONODA CORPORATION, prepared by mixing calcium aluminate and gypsum anhydride at a weight ratio of 1.0:2.0 was used as a rapid-hardening admixture. The fine aggregate was the grade 6. silica sand (silica sand produced in Yamagata; FM-value: 1.47). AP Setter made by Chichibu-Onoda Cement Corporation was used as a setting adjusting agent. C-250 made by Nakajima Kinzoku Hakufun Kogyo Company was used as aluminum powder. The additive used was an air entraining agent VINSOL made by Yamaso Kagaku Company and supply water was used as the additive water.

In this Example, silica sand was used as the joint filler sand.

Now, application of the present invention in the Example will be described below further in detail.

First, a tack coat layer was provided by spraying CATIOZOL GM in an amount of 0.4 liters/$m^2$ on the surface of the existing asphalt pavement. Then, after laying and leveling the grade 6. crushed stone into an average thickness of about 3 cm, an aggregate layer was provided by slightly roller-compacting the same with a steel-wheel roller. Subsequently, the natural stone blocks previously applied with CATIOZOL GM on the bottom and sides thereof substantially at a rate of 0.5 liter/$m^2$ as an asphalt coating were temporarily arranged one by one at prescribed positions on the aggregate layer while keeping prescribed joint intervals. The upper surface thereof was then slightly roller-compacted so that the upper surface of the Mikage-granite was at uniform height, thus completing laying of Mikage-granite.

Then, prior to pouring operation of CA mortar, preparation of CA mortar was conducted.

Preparation of CA mortar was accomplished by the use of a polyvinyl chloride container having a capacity of 100 liters and a hand mixer. In the first run of preparation of CA mortar, the PMS emulsion and additive water in required amounts were first charged into a container, and the setting adjusting agent AP setter in a required amount was added while slowly stirring the mixture by the hand mixer to prepare a mixed solution. Then, ordinary cement, the rapid-hardening admixture, the grade 6. silica sand, aluminum powder and the air trapping agent were added in required amounts, and then, the mixture was kneaded and mixed up for three minutes at a stirring rate of 1000 times/minute, thereby preparing CA mortar. The thus prepared CA mortar was immediately poured, and the second and subsequent runs of preparation of mortar were carried out in response to the progress of pouring operations.

As a result of tests, this CA mortar and CA concrete prepared by mixing and solidifying this CA mortar and aggregate had physical properties as shown in Table 1.

TABLE 1

Physical properties of CA mortar and CA concrete

| Division | Item of measurement | | Measured value | Measuring method |
|---|---|---|---|---|
| CA mortar | Initial flow time | | 6.8 sec. | Civil Eng. Soc. J type funnel method |
| | CA mortar temp. | | 20.0° C. | Rod-type thermometer |
| | Available time | | 30 min | Within flow time range 6–12 sec |
| | Hardening start time | | 70 min | Finger-sensed hardening |
| | Adhesive strength (material age: 28 days) | | 10.3 kgf/cm$^2$ | Building Research Institute Method |
| CA | Unconfined | Material age: | | |
| concrete (Note 1) | compressive strength | 2 hr | 6.1 kgf/cm$^2$ | Sample was prepared by placing the grade 6. crushed stone in a Marshall test mold (dia.: 101.6 mm, height: 76 mm) and filling the mold with CA mortar. |
| | | 3 hr | 11.2 kgf/cm$^2$ | |
| | | 1 day | 16.3 kgf/cm$^2$ | |
| | | 7 days | 28.6 kgf/cm$^2$ | |
| | | 28 days | 35.7 kgf/cm$^2$ | |
| | Shear | Material age: | | |
| | stress | 2 hr | (Unmeasurable) | Sample was prepared by placing the grade 6. crushed stone in a form of 30 cm long × 30 cm wide × 5 cm high, filling it with CA mortar for hardening, and after wet air curing, cutting out 5 cm deep × 5 cm wide × 20 cm long pieces at a prescribed material age. |
| | | 3 hr | (Unmeasurable) | |
| | | 1 day | 21.4 kgf/cm$^2$ | |
| | | 7 days | 40.8 kgf/cm$^2$ | |
| | | 48.9 kgf/cm$^2$ | | |
| | Elastic modulus (material age: 28 days) | | 15400 kgf/cm$^2$ | — |

(Note 1): Test temperature: 20° C.

The pouring operation was carried out by immediately subdividing the thus prepared CA mortar into a pouring pot provided with a discharge port meeting the joint width of the joint spaces, inserting the tip of the discharge port of the pouring pot, and pouring CA mortar along the joint space at a low speed, to form a buffer support layer by filling up the void of the aggregate layer with CA mortar, and to form an elastic joint filling part of the joint space. CA mortar filling operability was satisfactory.

Finally, the remaining upper portion of the joint space was filled with silica sand for finishing, thereby completing application of the method of the present invention.

Because the CA mortar was of the rapid-hardening type, the pavement could be opened to traffic promptly after the construction.

The natural stone blocks in the thus constructed block pavement is firmly secured on the base by the buffer support layer and the elastic joints, and at present when about a year has passed, no damage is observed, keeping the initial completed state of pavement, in a very good condition.

(EXAMPLE 2)

Block pavement was constructed directly on a base course for pavement.

The method of the present invention was applied in the same manner as in the Example 1 in terms of both materials used and constructing steps except that a different CA mortar was used.

The CA mortar used in this Example comprised, relative to 100 weight parts cement, 130 weight parts polymer-modified asphalt emulsion, 150 weight parts fine aggregate, 0.02 weight parts aluminum powder, 2 weight parts air entraining agent as an additive, and 35 weight parts additive water. High-early-strength Portland cement made by Chichibu-Onoda Cement Corporation was used as cement. NICHIREKI PMT Emulsion made by NICHIREKI COMPANY (nonionic asphalt emulsion: synthetic latex=90:10; evaporation residue: 60.8 wt. %, penetration (at 25° C.): 83) was used as a polymer-modified asphalt emulsion. The grade 6. silica sand (produced in Yamagata; FM-value: 1.47) was used as a fine aggregate. C-300 made by Nakajima Kinzoku Hakufun Kogyo Company was used as aluminum powder. VINSOL made by Yamaso Kagaku Company was used as an air entraining agent. Supply water was used as additive water.

CA mortar was prepared at the site by the use of a capacity of 70 liters polyvinyl chloride container and a hand mixer. First, the PMT emulsion and additive water were placed in the container, and the grade 6. silica sand, aluminum powder and the air entraining agent were added thereto while slowly stirring the mixture by the hand mixer. Then, after adding high-early-strength Portland cement, the mixture was kneaded and mixed at a stirring speed of 1,000 revolutions/minute of the mixer for four minutes, thereby preparing CA mortar. CA mortar and CA concrete prepared by mixing and solidifying this CA mortar and an aggregate had physical properties as shown in Table 2.

TABLE 2

Physical properties of CA mortar and CA concrete

| Division | Item of measurement | | Measured value | Measuring method |
|---|---|---|---|---|
| CA mortar | Initial flow time | | 8.0 sec | Civil Eng. Soc. J type funnel method |
| | CA mortar temp. | | 22.0° C. | Rod-type thermometer |
| | Available time | | 60 min | Range of flow time 6 to 12 sec |
| | Expansion gel start time | | 130 min | Finger-sensed |
| | Expansion coefficient | | +1.2% | Measuring cylinder method |
| | Breezing rate | | 0.0% | Civil Eng. Soc. polyvinyl bag method |
| | Unit volumn weight | | 1.527 g/cm$^2$ | Triangular flask method |
| | Adhesive strength (material age: 28 days) | | 9.2 kgf/cm$^2$ | Building Research Institute Method |
| CA | Un- | Material age: | | |
| concrete (Note 1) | confined compres- | 2 hr | (Unmeasurable) | Same sample preparing method |
| | | 3 hr | (Unmeasureable) | as in Table 1 |
| | sive | 1 day | 7.1 kgf/cm$^2$ | |
| | strength | 7 days | 26.5 kgf/cm$^2$ | |
| | | 28 days | 45.9 kgf/cm$^2$ | |
| | Shear | Material age: | | |
| stress | 2 hr | (Unmeasurable) | Same sample pre- | |
| | | | paring method | |
| | 3 hr | (Unmeasureable) | as in Table 1 | |
| | | 1 day | 3.1 kgf/cm$^2$ | |
| | | 7 days | 15.3 kgf/cm$^2$ | |
| | | 28 days | 34.7 kgf/cm$^2$ | |
| | Elastic modulus (material age: 28 days) | | 9267.9 kgf/cm$^2$ | — |

(Note 1): Test temperature: 20° C.

The natural stone block in the block pavement constructed by the use of this CA mortar was firmly secured to the base course by the buffer support layer and the elastic joint filler as in the Example 1, and has a sufficient durability against heavy traffic on an ordinary roadway.

(EXAMPLE 3)

As in the Example 2, block pavement was constructed directly on the base course for pavement.

A paving concrete plate was used as a paving block. Fine grooves were formed on the bottom surface thereof for the purpose of rapidly discharging air in the aggregate layer along with placing of CA mortar to permit rapid filling of CA mortar into the aggregate layer. The formed fine groove had a width of 1 cm and a depth of 1 cm, and two such fine grooves were provided per a block.

After arrangement of the paving blocks and prior to filling of CA mortar, joint space stoppers as CA mortar flowing stopper were temporarily provided in the joint spaces between the paving blocks. Foamed styrol formed into a round rod having a diameter of 13 mm was used as a joint space stopper, and such joint space stoppers were inserted substantially vertically at appropriate intervals at arbitrary positions in the joint spaces extending flat so that the lower ends of the joint space stoppers are in contact with the upper surface of the aggregate layer. These joint space stoppers partitioned the joint spaces into areas at intervals of about 1 m$^2$ on the paved surface.

CA mortar was poured into the partitioned joint space areas to fill the aggregate layer. Upon confirmation of the completion of filling of the aggregate layer, the joint space stoppers were removed. Then, CA mortar was poured also into the joint spaces, thereby completing the block pavement.

CA mortar used in this Example comprised, relative to 100 weight parts cement, 150 weight parts polymer-modified asphalt emulsion, 120 weight parts fine aggregate, 18 weight parts expansive admixture, 0.01 weight parts aluminum powder, 1 weight part air entraining agent as an additive, and 50 weight parts additive water.

High-early-strength Portland cement made by Chichibu-Onoda Cement Corporation was used as cement. NICHIREKI PMT Emulsion made by NICHIREKI COMPANY (nonionic asphalt emulsion: synthetic latex=90:10; evaporation residue: 61.0%, penetration: 93 (at 25° C.)) was used as a polymer-modified emulsion. The grade 6. silica sand was used as a fine aggregate. Lime-based Onoda AP made by ONODA CORPORATION was used as an expansive admixture. C-300 made by Nakajima Kinzoku Hakufun Kogyo Company was used as aluminum powder. Air entraining agent VINSOL made by Yamaso Kagaku Company was used as an additive. Supply water was used as additive water.

CA mortar was prepared at the site by the use of a grout mixer having a capacity of 120 liters. First, NICHIREKI PMT emulsion and additive water were charged, and the grade 6. silica sand, aluminum powder and the additive were added while stirring the mixture at a low speed (300 rpm). Then, after adding the expansive admixture and high-early-strength Portland cement, the mixture was kneaded and mixed for three minutes at a high speed (500 rpm) of the mixer, thereby preparing CA mortar.

CA mortar and CA concrete prepared by mixing and solidifying this CA mortar and the aggregate had physical properties, as a result of tests, were as shown in Table 3.

TABLE 3

Physical properties of CA mortar and CA concrete

| Division | Item of measurement | | Measured value | Measuring method |
|---|---|---|---|---|
| CA mortar | Initial flow time | | 6.3 sec | Civil Eng. Soc. J type funnel method |
| | CA mortar temp. | | 21.5° C. | Rod-type thermometer |
| | Available time | | 60 min | Range of flow time 6 to 12 sec |
| | Expansion gel start time | | 110 min | Finger-sensed |
| | Expansion coefficient | | +2.1% | Measuring cylinder method |
| | Breezing rate | | 0.0% | Civil Eng. Soc. polyvinyl bag method |
| | Unit volumn weight | | 1.520 g/cm$^3$ | Triangular flask method |
| | Adhesive strength (material age: 28 days) | | 10.4 kgf/cm$^2$ | Building Research Institute Method |
| | Cracking test | Material age: 91 days | No cracks | Visual observation |
| | (Note 2) | Material age: 180 days | No cracks | |
| CA concrete (Note 1) | Un-confined compres-sive strength | Material age: 1 day | 5.8 kgf/cm$^2$ | Same sample preparing method as in Table 1 |
| | | 7 days | 23.2 kgf/cm$^2$ | |
| | | 28 days | 38.0 kgf/cm$^2$ | |
| | Elastic modulus (material age: 28 days) | | 8100 kgf/cm$^2$ | |

(Note 1): Test temperature: 20° C.
(Note 2): The sample for the cracking test was prepared by placing CA mortar in a form of 200 cm long × 100 cm wide × 1 cm high and solidifying it.

Except for the above, block pavement was constructed directly on a base course for pavement in the same manner as in the Example 2.

The thus constructed block pavement, as in the Example 1, was firmly secured to the base course by the buffer support layer and the elastic joints, and had a sufficient durability against heavy traffic on an ordinary roadway. As a result of provision of fine grooves on the bottom surface of the paving blocks used and temporary installation of joint space stoppers as CA mortar flowing stopper in the joint spaces, pouring and filling of CA mortar could rapidly be carried out, and penetration of CA mortar into the aggregate layer was very uniform and sufficient, as compared with that in the Example 2.

Blending of expansive admixture into CA mortar permitted achievement of an expansion coefficient of CA mortar of +2.1 (%) which represented a smaller volume shrinkage as compared with the expansion coefficient of +1.2 (%) of the CA mortar in the Example 2.

(EXAMPLE 4)

A 60 cm long, 40 cm wide and 5 cm thick paving concrete plate was employed as a paving block. In place of providing fine grooves on the bottom surface of the paving concrete plate, semicircular fine grooves having a diameter of about 2 cm were provided in parallel with the longitudinal direction of the road at intervals of 20 cm on the upper portion of the aggregate layer Except for the above, block pavement was constructed with the same materials in the same constructing steps as in the Example 3.

It was possible to carry out pouring and filling of CA mortar rapidly, and penetration of CA mortar into the aggregate layer was very uniform and sufficient. The constructed block pavement was firmly secured to the base course by the buffer support layer and the elastic joint filler, and had a sufficient durability against heavy traffic on an ordinary roadway as in the Example 1.

(EXAMPLE 5)

Block pavement was constructed with the same materials and in the same steps of construction as in the Example 4 except that polyvinyl chloride hollow porous pipes having a diameter of 2 cm were buried in parallel with the longitudinal direction of the road at intervals of 20 cm in fine grooves provided on the upper portion of the aggregate layer.

It was possible to carry out pouring and filling of CA mortar rapidly, and penetration of CA mortar into the aggregate layer was very uniform and sufficient. The constructed block pavement was firmly secured to the base course by the buffer support layer and the elastic joints, and had a sufficient durability against heavy traffic on an ordinary roadway as in the Example 1.

(EXAMPLE 6)

Block pavement was constructed with the same materials and in the same steps of construction as in the Example 3 except that a polysulfide cold joint sealer (made by NICHIREKI COMPANY; NEOTAIYUSEALCOLD) was used as a joint filler into joint spaces between paving blocks after filling of CA mortar into the aggregate layer, and that no joint space stopper as CA mortar flowing stopper was temporarily provided in the joint spaces upon filling CA mortar into the aggregate layer.

The thus constructed block pavement was firmly secured onto the base course by the buffer support layer and the highly expanding and shrinking filled joints, and had a further higher durability against heavy traffic on an ordinary roadway.

INDUSTRIAL APPLICABILITY

The present invention having the construction as described above brings about the following effects:

1) According to the method of the present invention, unlike the conventional methods, it is possible to easily adjust the correct upper surface height of the paving blocks by means of adjusting the thickness of aggregate layer, even with slight irregularities in the base, or further even with paving blocks of non-uniform thickness, and by filling the void of the aggregate layer with CA mortar giving a uniform strength, it is possible to easily form a buffer support layer bonding the paving blocks and the base, thus providing an excellent installation operability.

2) Because CA mortar filling the aggregate layer has a high adhering property in the present invention, it suffices only to temporarily install the paving blocks, thus permitting rapid installing operation, not requiring masonry specialists, providing excellent placing operability.

3) When using rapid-hardening type CA mortar, the resultant pavement can be promptly opened for traffic.

4) Since CA mortar having a high adherence and a satisfactory elasticity is used in the present invention, the buffer support layer filled with CA mortar causes firm securing of the paving blocks to the base, and the elastic joints comprising CA mortar can firmly secure the blocks to each other. The block pavement constructed in the present invention can therefore effectively absorb and alleviate shock and vibration caused by traffic of vehicles, and sufficiently cope with stress produced by traffic of vehicles. It is therefore possible to provide block pavement excellent in durability against heavy traffic on an ordinary roadway.

5) By forming fine grooves on the bottom surface of the paving blocks or on the upper portion of the aggregate layer, or by burying hollow porous pipes into fine grooves formed on the upper portion of the aggregate layer, it is possible to rapidly discharge air in the aggregate layer upon filling CA mortar, thus permitting further improvement of placing operability.

6) Temporary installation of joint space stoppers as CA mortar flowing stopper at arbitrary flat positions in the joint spaces formed between paving blocks improves filling operability of CA mortar, and in addition, improves filling rate of CA mortar into the aggregate layer.

7) By using a pouring joint filler material rich in elasticity other than CA mortar in the joint spaces formed between the paving blocks after filling the aggregate layer with CA mortar, it is possible to further improve imperviousness of joints in service and follow up property to expansion and shrinkage of joints.

Construction of block pavement in the present invention brings about such excellent effects, so that it is possible to provide block pavement having an excellent durability with a beautiful appearance by applying for pavement of an ordinary roadway.

It is needless to mention that the present invention displays an excellent durability in application to various kinds of block pavement in an existing sidewalk or open space.

What is claimed is:

1. A method of constructing block pavement, which comprises the steps of providing a tack coat layer by spraying an asphalt emulsion as required on a base of a road or the like; then placing an aggregate on the upper surface thereof to form an aggregate layer; arranging a number of paving blocks on the upper surface thereof while keeping the upper surfaces of said block in flush; then pouring uniformly a cement asphalt mortar through joint spaces formed between said paving blocks to fill voids of said aggregate layer to form a buffer support layer; and filling also said joint spaces uniformly with the cement asphalt mortar or a pouring joint filler material other than the cement asphalt mortar, thereby securing paving blocks integrally on said base.

2. A method of constructing block pavement according to claim 1, wherein said aggregate is single-sized or has a continuous grading of particle size.

3. A method of constructing block pavement according to claim 1, wherein said aggregate is an asphalt-coated aggregate.

4. A method of constructing block pavement according to claim 1, wherein, upon arranging paving blocks, an asphalt coating is applied by previously applying an asphalt emulsion onto the bottom surfaces and the side surfaces of said paving blocks, and arranging the same.

5. A method of constructing block pavement according to claim 1, wherein fine grooves are provided on the bottom surfaces of said paving blocks.

6. A method of constructing block pavement according to claim 1, wherein fine grooves are provided in the upper portion of said aggregate layer.

7. A method of constructing block pavement according to claim 6, wherein hollow porous pipes, coil-spring-like pipes, or hollow gridiron pipes are buried singly or in combination into said fine grooves formed in the upper portion of the aggregate layer.

8. A method of constructing block pavement according to claim 1, wherein a plurality of joint space stoppers for filling the space at least up to the upper end of the paving blocks are temporarily provided along the height of the paving blocks at arbitrary flat positions in the joint spaces formed by arranging the paving blocks, with the upper surface of the aggregate layer as the lower end, then, filling up the void of the aggregate layer by pouring the cement asphalt mortar into the joint spaces surrounded by said joint space stoppers, the joint space stoppers are removed, and the joint spaces are filled uniformly with the cement asphalt mortar or a pouring joint filler material other than the cement asphalt mortar.

9. A method of constructing block pavement according to claim 1, wherein said cement asphalt mortar comprises, relative to 100 weight parts cement, from 50 to 230 weight parts asphalt emulsion, from 0 to 100 weight parts rapid-hardening admixture, from 60 to 330 weight parts fine aggregate, from 0 to 5 weight parts setting adjusting agent, from 0 to 0.05 weight parts aluminum powder, from 0 to 40 weight parts expansive admixture, from 1 to 5 weight parts additive and additive water.

10. A method of constructing block pavement according to claim 9, wherein said cement comprises one or more selected from the group consisting of normal Portland cement, high-early-strength Portland cement, extra-high-early-strength Portland cement, moderate heat Portland cement, Blast-furnace slag cement, silica cement, fly ash cement, sulfate resistant cement and jet cement in blend.

11. A method of constructing block pavement according to claim 9, wherein said asphalt emulsion is a nonionic polymer-modified asphalt emulsion obtained by mixing an asphalt emulsion and a synthetic latex at a weight ratio of 99–75:1–25.

12. A method of constructing block pavement, which comprises the steps of:

placing an aggregate on the upper surface of a base of a road or the like to form an aggregate layer having voids therewithin;

arranging a number of paving blocks on the upper surface of the aggregate layer while keeping the upper surfaces of said blocks in flush;

then pouring a cement asphalt mortar through joint spaces formed between said paving blocks to fill the voids within said aggregate layer to form a buffer support layer, said cement asphalt mortar having good viscoelastic and adhesive properties, and being sufficiently flowable to flow into the voids within said aggregate layer; and filling said joint spaces with the cement asphalt mortar or a pouring joint filler material other than the cement asphalt mortar, thereby securing paving blocks integrally on said base.

13. A method of constructing block pavement according to claim 12, wherein said aggregate is single-sized or has a continuous grading of particle size.

14. A method of constructing block pavement according to claim 12, wherein said aggregate is an asphalt-coated aggregate.

15. A method of constructing block pavement according to claim 12, wherein, upon arranging paving blocks, an asphalt coating is applied by previously applying an asphalt emulsion onto the bottom surfaces and the side surfaces of said paving blocks, and arranging the same.

16. A method of constructing block pavement according to claim 12, wherein fine grooves are provided on the bottom surfaces of said paving blocks, in the upper portion of said aggregate layer, or both on the bottom surfaces of said paving blocks and in the upper portion of said aggregate layer.

17. A method of constructing block pavement according to claim 16 in which fine grooves are provided in the upper portion of said aggregate layer, further comprising burying hollow porous pipes, coil-spring-like pipes, or hollow grid iron pipes, singly or in combination into said fine grooves formed in the upper portion of said aggregate layer, prior to said arranging of said paving blocks on the upper surface of the aggregate layer.

18. A method of constructing block pavement according to claim 12, wherein a plurality of joint space stoppers for filling the space at least up to the upper end of the paving blocks are temporarily provided along the height of the paving blocks at arbitrary flat positions in the joint spaces formed by arranging the paving blocks, with the upper surface of the aggregate layer as the lower end, then filling up the voids of the aggregate layer by pouring the cement asphalt mortar into the joint spaces surrounded by said joint space stoppers, removing the joint space stoppers, and then carrying out the step of uniformly filling the joint spaces with the cement asphalt mortar or a pouring joint filler material other than the cement asphalt mortar.

19. A method of constructing block pavement according to claim 12, wherein said cement asphalt mortar comprises, relative to 100 weight parts cement, from 50 to 230 weight parts asphalt emulsion, from 0 to 100 weight parts rapid-hardening admixture, from 60 to 330 weight parts fine aggregate, from 0 to 5 weight parts setting adjusting agent, from 0 to 0.05 weight parts aluminum powder, from 0 to 40 weight parts expansive admixture, from 1 to 5 weight parts additive and additive water.

20. A method of constructing block pavement according to claim 19, wherein said cement comprises one or more components selected from the group consisting of normal Portland cement, high-early-strength Portland cement, extra-high-early-strength Portland cement, moderate heat Portland cement, Blast-furnace slag cement, silica cement, fly ash cement, sulfate resistant cement and jet cement in blend.

21. A method of constructing block pavement according to claim 19, wherein said asphalt emulsion is a nonionic polymer-modified asphalt emulsion obtained by mixing an asphalt emulsion and a synthetic latex at a weight ratio of 99–75:1–25.

* * * * *